United States Patent [19]

Vaterlaus

[11] Patent Number: 4,465,121

[45] Date of Patent: Aug. 14, 1984

[54] METHOD AND APPARATUS FOR BENDING A STRAND IN A CONTINUOUS CASTING INSTALLATION FOR METALS, ESPECIALLY STEEL

[75] Inventor: Arthur Vaterlaus, Rüschlikon, Switzerland

[73] Assignee: Concast Service Union AG, Zurich, Switzerland

[21] Appl. No.: 365,166

[22] Filed: Apr. 5, 1982

[30] Foreign Application Priority Data

Apr. 30, 1981 [CH] Switzerland ..... 2818/81

[51] Int. Cl.[3] ..... B22D 11/06

[52] U.S. Cl. ..... 164/484; 164/442

[58] Field of Search ..... 164/442, 448, 484

[56] References Cited

U.S. PATENT DOCUMENTS

| | | | |
|---|---|---|---|
| 3,324,931 | 6/1967 | Bungeroth | 164/442 |
| 3,707,180 | 12/1972 | Vogt | 164/484 |
| 3,729,048 | 4/1973 | Gelfenbein | 164/484 |
| 3,893,503 | 7/1975 | Eibl | 164/442 |
| 4,058,154 | 11/1977 | Streubel | 164/448 |

*Primary Examiner*—Nicholas P. Godici
*Assistant Examiner*—Marc Hodak
*Attorney, Agent, or Firm*—Werner W. Kleeman

[57] ABSTRACT

In a method and apparatus for bending a strand in a continuous casting installation for metals, especially steel, the ferrostatic pressure of the liquid core or pool of the cast strand is supported at a transition curve along a bending path between a circular arcuate-shaped roller apron path or track and a straight roller apron path or track by means of pairs of support rolls. In order to obtain uniform low elongation velocities at the strand skin or sheel throughout the entire transition curve for the purpose of improving the surface quality of the cast strand and for avoiding structural flaws at the solid-liquid interface as well as for simplifying the adjustment, alignment and maintenance work, the transition curve along the roller apron track is continuously accommodated to changing casting and/or strand parameters by the action of the strand itself.

10 Claims, 6 Drawing Figures

2
1
4
11'
11
7'
7
9
10
14
5
9
16
15
8
10
12
8'
13
12'
6

22
R₀
26
φ₀
20
25
24
23
21
y₀
x
L 6
18
12
16'
4
8
9
7
11
13
12'
8'
14
10
15
7'
11'

METHOD AND APPARATUS FOR BENDING A STRAND IN A CONTINUOUS CASTING INSTALLATION FOR METALS, ESPECIALLY STEEL

BACKGROUND OF THE INVENTION

The present invention relates to a new and improved method of, and apparatus for, bending a strand in a continuous casting installation, especially for casting steel strands.

Generally speaking, the invention contemplates supporting the ferrostatic pressure of a continuously cast strand having a liquid core or sump at a transition curve along a bending path between a circular arcuate-shaped roller apron track and a linear roller apron track by means of pairs of support rolls.

During the bending of continuously cast strands in continuous casting installations for steel, it is already known in this technology, for instance from German Patent Publication No. 2,341,563 and the corresponding U.S. Pat. No. 3,893,503, granted July 8, 1975, both during bending of a straight strand along a circular arc and also during the straightening of a curved strand, to accomplish the bending work in a number of successive steps, so that the strand is less intensely loaded at the bending region or zone in contrast to a single-point bending or single-point straightening, as the case may be. During the stepwise bending operation the bending radius is therefore stepwise or incrementally reduced and/or during the stepwise straightening operation such bending radius is stepwise or incrementally increased. When designing a continuous casting installation for casting strands working with an arc-type or curved continuous casting mold having a relatively small radius and with a subsequently arranged circular arcuate-shaped roller apron or strand supporting and guide arrangement as well as a stepwise straightening operation, there can be obtained a low structural height of the installation and, in actual practice, tolerable elongation values at the strand shell or skin in the straightening section of the roller apron. However, the alignment of such roller aprons or strand supporting and guiding arrangements is extremely complicated because, on the one hand, the rolls or rollers of both support tracks must be exactly aligned along the bending path and, on the other hand, the bending path must be exactly aligned with respect to the curved roller apron track and the straight roller apron track.

Furthermore, there is known to the art, for instance as exemplified by U.S. Pat. No. 3,324,931, granted June 13, 1967, a roller apron or strand supporting and guide arrangement for supporting and guiding as well as for deflecting or turning an only partially solidified cast strand. With this roller apron at the roll pair bounding the bending path of a straight and a curved part of the roller apron one of the rolls is fixedly arranged. Along the bending path there are arranged roll pairs for supporting the ferrostatic pressure, and at least four of such rolls are rigidly connected to form force-transmitting bending or straightening rolls, as the case may be, and of which two are provided at the side of the strand where the fibers undergo tensile forces and at least two are provided at the side of the strand where the fibers experience compressive forces. Also with this bending apparatus the exact alignment of the rolls along the transition curve and in relation to the circular arcuate-shaped roller apron track and the straight roller apron track is difficult and time-consuming. During bending of the continuously cast strand, the elongation velocity or speed at the solidification front alters in a stepwise or incremental fashion along the bending path from null up to a maximum value and again then in stepwise fashion back to null. This bending characteristic increases the total bending path by the ascending and the descending portion of the elongation velocity change along the bending path. In order to obtain small elongation velocity values along a bending path between a straight continuous casting mold and a circular arcuate-shaped roller apron section, it is therefore necessary to provide a corresponding length for such bending path with a corresponding structural height of the continuous casting installation, something negatively affecting the costs of the continuous casting installation. The alignment work which must be accomplished at such bending path poses high demands and requirements and is complicated and time-consuming to carry out.

SUMMARY OF THE INVENTION

Therefore, with the foregoing in mind it is a primary object of the present invention to provide a new and improved method of, and apparatus for, bending a continuously cast strand in a continuously casting installation for metals, especially steel, in a manner not afflicted with the aforementioned drawbacks and limitations of the prior art proposals.

Another and more specific object of the present invention aims at providing a new and improved method of, and apparatus for, bending a continuously cast strand in a manner overcoming the previously discussed drawbacks and limitations and, in contrast to state-of-the-art bending methods, imposing upon the strand lower elongation values and elongation velocities, so that, on the one hand, there can be avoided fissures or cracks at the surface of the strand shell or skin and structural flaws or defects at the solid-liquid interface and, on the other hand, affording a simpler and more economical construction of the bending apparatus.

Yet a further significant object of the present invention aims at providing a strand bending apparatus which appreciably simplifies the adjustment, alignment and maintenance work along the transition curve.

A further significant object of the present invention aims at a new and improved apparatus for bending a cast strand at a continuous casting installation, which apparatus is relatively simple in construction and design, extremely economical to manufacture, highly reliable in operation, not readily subject to breakdown or malfunction, and allows continuous accommodation or adjustment of the transition curve along the roller apron track of the bending path to altering strand and/or casting parameters by the action of the continuously cast strand itself.

Now in order to implement these and still further objects of the invention, which will become more readily apparent as the description proceeds, the method aspects of the present development are manifested by the features that, the transition curve along the roller apron track of the bending path is continuously accommodated or adjusted to altering strand parameters by the action of the continuously cast strand itself. Also, the transition curve along the roller apron track of the bending path can be continuously accommodated to altering casting parameters likewise by the action of the strand itself.

As already alluded to above, the invention is not only concerned with the aforementioned method aspects, but also relates to a new and improved construction of bending apparatus which is generally manifested by the features that, all of the support roll pairs between the circular arcuate-shaped section and the linear or straight section of the roller apron are each independently guided so as to be freely movable, by the action of the strand, transversely with respect to the direction of strand travel.

With the inventive method and the inventive bending apparatus there beneficially can be attained the result that there is adjusted a minimum constant elongation velocity or speed in the strand shell or skin over the entire length of the bending path, and consequently, there arise minimal loads at the strand surface and at the solid-liquid interface. A desired or permissible elongation speed can be adjusted by selection of the length of the bending path. Hence, even with difficult to cast steel qualities and/or when working with high casting speeds, there are advantageously produced continuously cast strands or castings which are relatively free of structural flaws or defects. All of the rolls or rollers along the bending path between the curved section and the straight or linear section of the roller apron or strand supporting and guide arrangement do not transmit transverse forces or any bending forces. The bending and straightening apparatus therefore can be constructed in a more simple manner and, consequently, there is realised beneficial savings in costs. Additional advantages reside by virtue of the fact that, the adjustment and alignment work along the transition curve can be dispensed with, and hence, there is appreciably simplified the maintenance work at the continuous casting installation. Also, alignment errors of the circular arcuate-shaped roller apron section and the straight roller apron section with respect to one another practically have no negative effects upon the quality of the cast strand, because the transversely movable or floating roll pairs tend to self-adjust themselves along the bending path to a correspondingly optimum transition curve. An extension or elongation of the bending path to three or more meters length within the metallurgically required support length is readily possible and can be accomplished practically without any increased costs. Hence, there is obtained extremely low loading of the strand shell or skin, which produces extremely low roll bending loads at the circular arcuate-shaped roller apron track and the straight roller apron track. The inventive method also renders possible an optimum continuous accommodation of the transition curve to actively induced altering casting parameters and/or the altering resultant strand parameters. In this context, there is particularly considered long lasting sequential pours with changes in the format of the cast strand during the casting operation and large changes in the casting speed, the cooling capacity or output and/or the steel quality.

The connection or merge point of the transition curve at the circular arcuate-shaped path can be randomly selected. If, for instance, the structural height of a continuous casting installation for strands should be low and there is only desired a low ferrostatic pressure at the horizontal section of the guide arrangement, then the connection or merge point of the transition curve with the circular arc at the straightening section can be located near to a curved or arc-type mold having a relatively small radius. Optimum conditions for the position of the connection or merge point between a circular arc or path and the transition curve can be realised if the transition curve merges at the circular arc at an angle $\rho_o$, wherein the angle $\rho_o$, during bending, is measured from the horizontal, and during straightening, is measured from the vertical radius line of the circular arc or circular arcuate-shaped path, and computed according to the equation;

$$\rho_o = \arctan \frac{L}{2 \cdot R_o}$$

In the above equation $R_o$ constitutes the selected radius of the circular arcuate-shaped path or circular arc and L the selected length of the transition curve.

A spacing $Y_o$ between a connection or merge point at the circular arcuate-shaped path or circular arc and an extension of the straight strand path can be computed from the following equation:

$$Y_o = \frac{L^2}{6 \cdot R_o}$$

In the above equation $R_o$ constitutes the selected radius of the circular arcuate-shaped path or circular arc and L the selected length of the transition curve.

Basically, it is possible to provide one or both rolls of a transversely displaceable supporting roll pair, along the bending path, with a resilient or hydraulic overload safety device or facility. However, because such support rolls need not take-up any bending forces, it is especially economical to arrange the support roll pairs to be freely movable or floating while maintaining the mutual spacing of the rolls correlated to one roll pair. By omitting any overload safety facility at such roll pairs it is possible to particularly simply construct the roller apron or strand support and guide arrangement along the bending path.

Within the circular arcuate-shaped roller apron track or path and the essentially straight roller apron track or path there can arise at the rolls larger bending forces and bending reaction forces transversely with respect to the direction of travel of the continuously cast strand. Depending upon the momentary strand temperature, the strand cross-section and so forth, such rolls could be loaded beyond the permissible load limit and therefore become damaged. Hence, it is of particular advantage if at the circular arcuate-shaped portion or section of the roller apron and at the straight section or portion of the roller apron there are arranged, in each case, before and after, respectively, the roll pair bounding at the bending path freely movable roll pairs which can likewise move transversely with respect to the strand travel direction by the action of the continuously cast strand.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
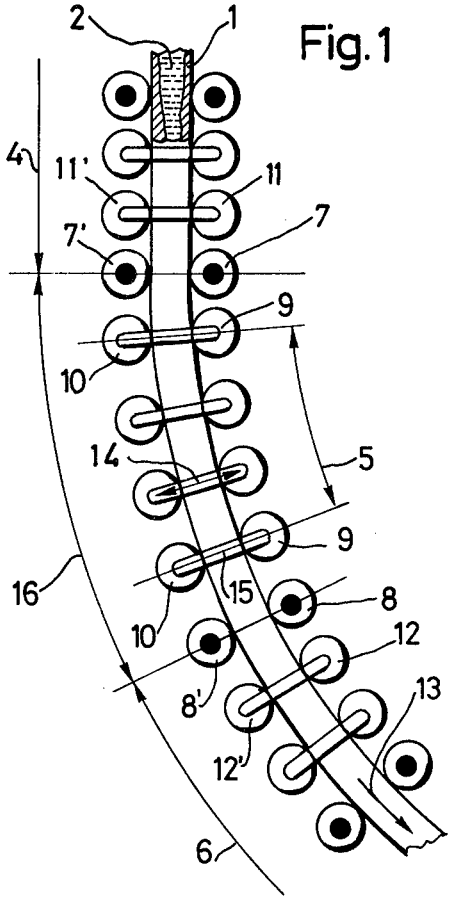
FIG. 1 is a sectional view of a schematically illustrated roller apron track at the bending portion or section of a continuously cast strand.

Describing now the drawings, it is to be understood that for purposes of simplifying the illustration only enough of the construction of a continuous casting installation has been shown to enable those skilled in this art to readily understand the underlying principles and concepts of the present development. Turning attention now therefore to FIG. 1, there is shown a section or portion of a cast strand 1 having a liquid core or sump 2 at a portion of a roller apron or strand supporting and guide arrangement which is composed of a linear portion or section 4, a bending path 5 and a circular arcuate-shaped section or portion 6. All of the rolls or rollers 7 to 12 are arranged such that they support the ferrostatic pressure of the liquid core 2 of the continuously cast strand 1, and thus, prevent any undesirable bowing-out of the cast strand.

Roll pairs 7, 7' and 8, 8', respectively, bound the bending path 5. The roll pairs 7, 7' constitute the last pair of rolls appearing in the straight or linear section 4 of the roller apron and the roll pair 8, 8' constitutes the last roll pair appearing in the curved portion or section of the roller apron. These rolls 8, 8' and 7, 7', as a general rule, are rigidly attached to the machine frame. Along the bending path 5 of the roller apron all of the support roll pairs 9, 10 are each guided to be freely movable by the action of the strand 1, in the direction of the double-headed arrow 14, transversely with respect to the direction of travel 13 of such strand. Consequently, the strand 1 automatically adjusts or regulates the roll pairs 9, 10 along the bending path 5 to an optimum bending curve. The respective support roll pairs 9, 10 each can be rigidly interconnected by means of brackets 15 or equivalent structure for retaining their mutual spacing from one another. These brackets 15 or equivalent connection means take-up the force which is produced by the ferrostatic pressure. In order to limit overload forces at 110 to 120% of the support force for the ferrostatic pressure, the brackets or bracket members 15 can be equipped with appropriately designed known elastic overload safety facilities or devices.

Roll pairs 11, 11' at the straight portion or section 4 and roll pairs 12, 12' at the curved section or circular arcuate-shaped portion 6 of the roller apron or strand supporting and guiding arrangement, which, in the arrangement of FIG. 1, viewed in the direction of strand travel 13 can be arranged forwardly and after the roll pairs 7, 7' and 8, 8' bounding the bending path 5, if desired can be likewise guided to be freely movable transversely with respect to the strand travel direction 13 by the action of the strand 1 itself. Consequently, these rolls are likewise relieved of bending and reaction forces. It is advantageous if these forces are taken-up by rolls or rollers which are spaced at a considerable distance from the roll pairs 7, 7' and 8, 8', respectively.

Figure 2:
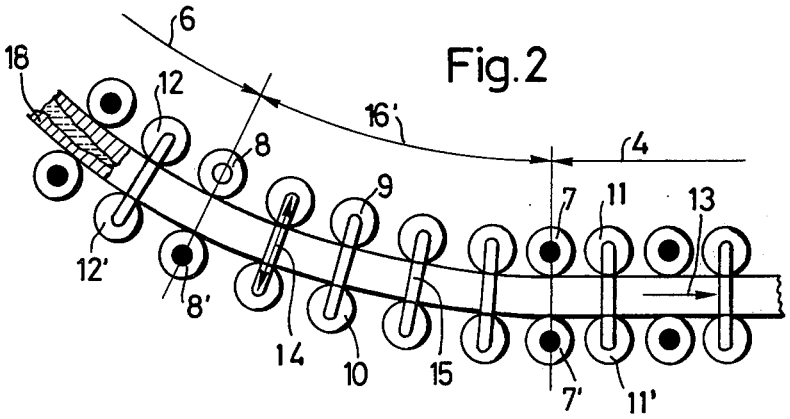
FIG. 2 is a fragmentary view of a schematically depicted roller apron track at the straightening section or portion of a curved strand.

With the arrangement of FIG. 2 there have been used the same reference characters to denote essentially the same or analogous components as in the arrangement of FIG. 1. The difference between the system design in FIG. 1 and that in FIG. 2 resides in the fact that, along the transition curve 16 of FIG. 1 there is bent a straight strand 1 and along the transition curve 16' of the arrangement of FIG. 2 there is straightened a curved strand 18.

Figure 3:
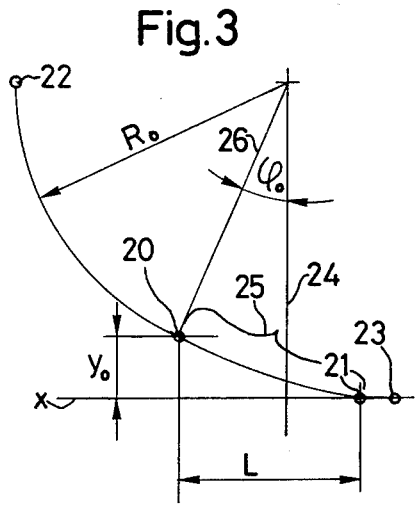
FIG. 3 is a sketch serving to explain the geometric magnitudes of a bending line between a circular arc and a straight line.

Now in FIG. 3 there has been illustrated a transition curve 25 at the straightening region between the connection or merge points 20 and 21. Between the point 20 and the point 22 there has been illustrated a circular arcuate-shaped path having a radius $R_o$ and between the point 21 and the point 23 a straight or linear path. Reference character $Y_o$ represents the height of the point 20 above the prolongation or extension of the linear path, which simultaneously forms the X-axis. An angle $\rho_o$ lies between a vertical radius line 24 and a straight line 26 extending through the connection or merge point 20. The position of both connection or merge points 20 and 21, upon predetermining the radius $R_o$ for the circular arc and the horizontal length L of the transition curve 25, can be computed as follows: The angle $\rho_o$, which during bending is measured from a horizontal and during straightening from the vertical radius line 24 of the circular arc, can be computed according to the following equation:

$$\rho_o = \arctan \frac{L}{2 \cdot R_o}$$

wherein, reference character $R_o$ represents the selected radius of the circular arc or circular arcuate-shaped path and reference character L represents the selected length of the transition curve.

The spacing $Y_o$ between the connection or merge point 20 of the transition curve at the circular arc and a prolongation or extension of the linear path (X-axis) can be computed from the following equation:

$$Y_o = \frac{L^2}{6 \cdot R_o}$$

wherein, reference character $R_o$ represents the selected radius of the circular arc and reference character L represents the selected length of the transition curve.

The elongation speed $\epsilon$ at a fiber located at a spacing a from the neutral axis of the strand can be computed as follows:

$$\dot{\epsilon} = \frac{100 \cdot a \cdot Vs}{R_o \cdot L} \left( \frac{\%}{\text{sec}} \right)$$

wherein, reference character Vs represents the casting speed in mm/sec.

The following example shows numerical values as the same are conventional in practice. There has been assumed that there was used a continuous casting installation working with a curved or arc-type mold and with a curved roller apron or strand supporting and guide arrangement.

| | |
|---|---|
| $R_o$ | = 10,000 mm |
| L | = 2,000 mm |
| $\rho$ | = 5.73° |

-continued

| | |
|---|---|
| $Y_o$ | = 66.7 mm |
| Strand thickness | = 250 mm |
| Casting speed Vs | $= \frac{1m}{min} = \frac{16.6\ mm}{sec}$ |
| Solidification coefficient K | = 26 (mm · min$^{-\frac{1}{2}}$) |
| Supported roller apron | = 23.1 m |
| $\phi$ Shell thickness along the transition curve | = 103 mm |
| Spacing a from the neutral axis of the strand up to the solidification front | = 22 mm |

Elongation change $\Sigma = \frac{100 \cdot a}{R_o \cdot L} = 0 \cdot 11 \cdot 10^{-3} \left(\frac{\%}{mm}\right)$ Elongation speed $= 1.83 \cdot 10^{-3} \left(\frac{\%}{sec}\right)$ The elongation values in this example are approximately lower by a factor of 10 than with a similar roller apron having a single-point straightening unit.

Figure 4:
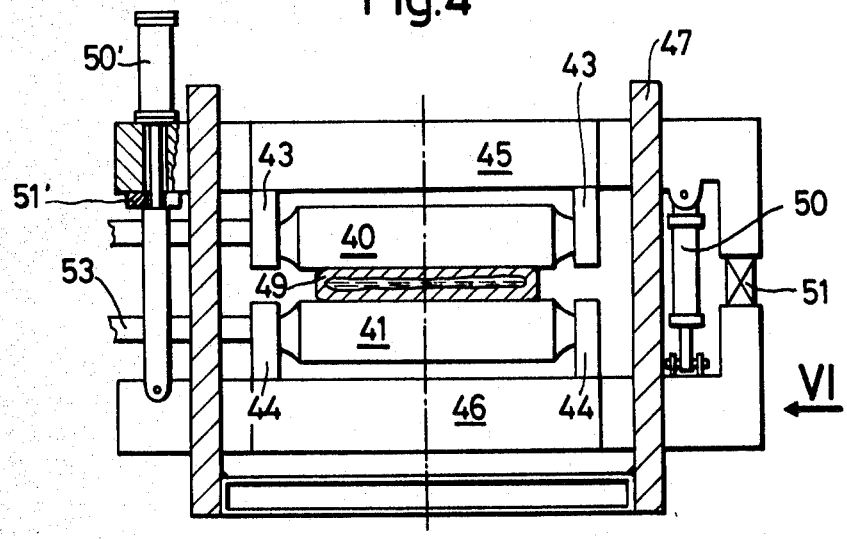
FIG. 4 is a sectional view through a roller apron or support guide framework.
Figure 5:
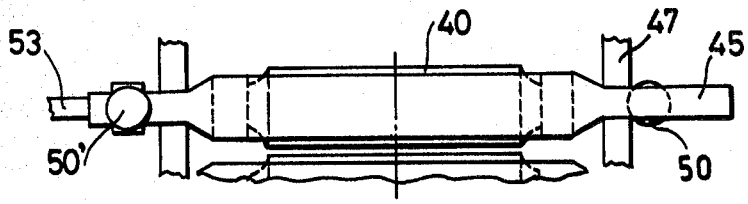
FIG. 5 is a top plan view of the support guide or roller apron framework according to the arrangement of FIG. 4.
Figure 6:
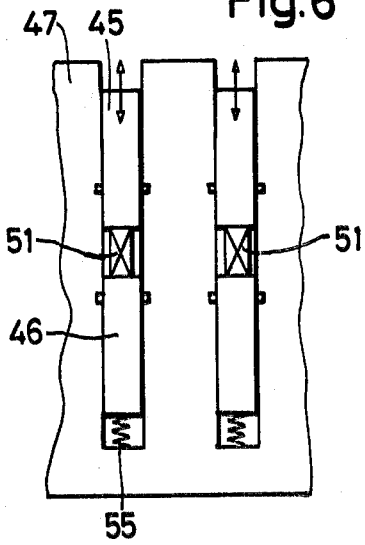
FIG. 6 is a side view of the arrangement of FIG. 4, looking essentially in the direction of the arrow VI thereof.

Continuing, in the arrangement of FIGS. 4, 5 and 6 rolls 40 and 41 are secured by means of their bearings 43 and 44 at the yokes or traverses 45 and 46. The rolls 40 and 41 form a support roll pair which is arranged along a bending or straightening path, but also could be arranged along a curved or straight roller apron or support and guide arrangement.

The yokes or traverses 45 and 46 are clamped against stops or impact members 51 and 51' by the action of power or force-applying devices 50 and 50', respectively, so that the roll or roller pair 40, 41 forms a force-lockingly or positively closed unit. Guides or guide elements 47 are provided to both sides of the roller apron. These guide elements 47 guide the traverses 45 and 46, so that the roll pair 40, 41 is freely movable by the action of the strand 49 transversely with respect to the direction of strand travel.

The power or force-applying devices 50 and 50', which can be constructed, for instance, as hydraulic piston-and-cylinder units, support the ferrostatic pressure of the cast strand 49. Bending or straightening forces need not be taken-up by such force-applying devices 50, 50'. Instead of using such force-applying devices 50, 50' there also could be employed traction rods or spindles or the like.

At the left-hand side of the arrangement of FIG. 4 the force-applying device 50' and the stop or impact member 51' are positioned such that there can be outwardly extended the drive shafts 53 for the rolls or rollers 40 and 41. At the right-hand side of the arrangement of FIG. 4, there has been illustrated the force-applying device 50 for an exemplary embodiment working with non-driven rolls.

In FIG. 6 there has been schematically illustrated a weight compensation for each roll pair 40, 41 in the form of a related spring 55 or equivalent structure. Such weight compensation, which is only necessary with vertical or inclined arrangement of the guides or guide elements 47, also could consist of a counter weight or a grease nut. The effectiveness of the weight compensation, as a rule, is only necessary until there has been introduced a dummy bar into the roller apron.

The described method and apparatus are not only suitable for the casting of slab sectional shapes. There also can be obtained particular advantages during casting of large bloom formats and pre-profiles for supports (dog bones), because such pre-profiles place particularly great requirements on the straightening process as concerns freedom of fissures or cracks at the cast strand.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of bending a continuously cast strand in a continuous casting plants, comprising the steps of:

bending the strand along a transition curve between a circularly arcuate roller apron track and a substantially straight roller apron track;

supporting ferrostatic pressure of a liquid core of the strand by means of a plurality of support roll pairs along the transition curve;

bending the strand along the transition curve exclusively by means of support roll pairs located in the circularly arcuate roller apron track and in the straight roller apron track;

supporting the ferrostatic pressure of the strand between the circularly arcuate roller apron track and the straight roller apron track by support roll pairs not contributing to the bending action and free to move in a direction transverse to the strand; and the configuration of the transition curve being determined by constantly changing casting and strand parameters of the strand being bent.

2. The method as defined in claim 1, wherein:

a predetermined speed of elongation is obtained by correspondingly selecting the length of said transition curve.

3. The method as defined in claim 1, wherein:

said support roll pairs not contributing to the bending action being fixed to a frame of the continuous casting plant and being employed to positively define respective merge points of the transition curve with the circularly arcuate roller apron track and the substantially straight track.

4. The method as defined in claim 1, wherein:

said transition curve merges with a circular arcuate-shaped path at an angle $\rho_o$; and said angle $\rho_o$, during bending, is measured from a horizontal and, during straightening, is measured from a vertical radius line of the circular arcuate-shaped path and is computed according to the equation $$\rho_o = \arctan \frac{L}{2 \cdot R_o},$$

wherein, $R_o$ designates the selected radius of the circular acruate-shaped path and reference character L designates the selected length of the transition curve.

5. The method as defined in claims 1 or 3, further including the steps of:

computing the spacing $Y_o$ between a merge point of the transition curve with the circular arcuate-shaped path and an extension of a straight line of the horizontal in accordance with the equation $$Y_o = \frac{L^2}{6 \cdot R_o},$$

wherein $R_o$ designates the selected radius of the circular arcuate-shaped path and reference character L designates the selected length of the transition curve.

6. A bending apparatus for bending a continuously cast strand in a continuous casting installation, comprising:

strand support and guide means for supporting and guiding the strand along a transition curve between a circular arcuate-shaped portion and a substantially straight portion of the strand support and guide means;

said strand support and guide means containing support roll pairs for supporting the ferrostatic pressure of a partially solidified strand;

said support roll pairs including bending rolls arranged only on the circular arcuate-shaped portion and the straigt portion of the strand support and guide means;

said support roll pairs including respective roll pairs which bound the transition curve and have at least one roll thereof fixedly arranged;

all support roll pairs located between the circular arcuate-shaped portion and the straight portion of the strand support and guide means being structured as support rolls for supporting the ferrostatic pressure;

all of said support roll pairs within said transition curve being structured such that each is freely movable by the action of the strand transversely with respect to the direction of strand travel; and the transition curve being determined by the strand and the momentary casting parameters.

7. The bending apparatus as defined in claim 5, further including:

means for freely movably guiding the support roll pairs within the transition curve while maintaining the mutual spacing of the support rolls of each support roll pair.

8. The bending apparatus as defined in claim 5, wherein:

at the circular arcuate-shaped portion of the strand support and guide means there is arranged and guided forwardly and after the roll pair bounding the bending path freely movable roll pairs which are movable transversely with respect to the strand direction of travel by the strand while maintaining their mutual spacing from one another.

9. The bending apparatus as defined in claim 5 or 6, wherein:

at the straight portion of the strand support and guide means there is arranged and guided in each case before and after the roll pair bounding the bending location freely movable roll pairs which are movable by the action of the strand transversely with respect to the direction of strand travel while maintaining their mutual spacing from one another.

10. The bending apparatus as defined in claim 5, wherein:

said respective roll pairs being fixed to a frame of the continuous casting plant to positively define respective merge points of the transition curve with the circularly arcuate roller apron track and with the substantially straight roller apron track.

* * * * *